US008966726B2

(12) United States Patent
Chua et al.

(10) Patent No.: US 8,966,726 B2
(45) Date of Patent: Mar. 3, 2015

(54) BODY BAG HAVING ABSORBENT LINING AND IMPROVED PERIPHERAL SEAL

(75) Inventors: Kenneth S. Chua, Glenview, IL (US); Daniel B. Love, Libertyville, IL (US); Kristen Pazely Kanka, Wauconda, IL (US); Benjamin Palmer, Menomonee Falls, WI (US)

(73) Assignee: Medline Industries, Inc, Mundelein, IL (US)

( * ) Notice: Subject to any disclaimer, the term of this patent is extended or adjusted under 35 U.S.C. 154(b) by 228 days.

(21) Appl. No.: 13/347,146

(22) Filed: Jan. 10, 2012

(65) Prior Publication Data

US 2013/0174392 A1 Jul. 11, 2013

(51) Int. Cl.
*A61G 1/00* (2006.01)

(52) U.S. Cl.
USPC ..... 27/28; 383/66; 383/107

(58) Field of Classification Search
USPC ..... 27/27, 28; 383/66, 107, 109, 113, 6; 493/186, 212, 217, 226, 243; 112/475.08; 604/367
See application file for complete search history.

(56) References Cited

U.S. PATENT DOCUMENTS

| | | | | |
|---|---|---|---|---|
| 4,780,940 | A * | 11/1988 | Jay | 27/28 |
| 4,790,051 | A * | 12/1988 | Knight | 27/28 |
| 5,341,548 | A | 8/1994 | Zerick | |
| 5,659,933 | A * | 8/1997 | McWilliams | 27/28 |
| 5,715,583 | A * | 2/1998 | Sandoval | 27/11 |
| 7,228,603 | B2 * | 6/2007 | Craig | 27/28 |
| 7,337,511 | B2 | 3/2008 | Yu et al. | |
| 7,484,275 | B2 * | 2/2009 | Carroll et al. | 27/28 |
| 7,496,995 | B2 * | 3/2009 | Rosario et al. | 27/28 |
| 8,146,217 | B2 * | 4/2012 | Jensen et al. | 27/28 |
| 2009/0118562 | A1 * | 5/2009 | Cole et al. | 588/313 |
| 2010/0263178 | A1 * | 10/2010 | Jensen et al. | 27/28 |
| 2010/0310854 | A1 | 12/2010 | Nagami et al. | |
| 2011/0162178 | A1 | 7/2011 | Jensen et al. | |
| 2012/0284923 | A1 * | 11/2012 | Jensen et al. | 5/627 |
| 2012/0296293 | A1 * | 11/2012 | Clifford et al. | 604/367 |

FOREIGN PATENT DOCUMENTS

WO WO-2009/061850 5/2009

* cited by examiner

*Primary Examiner* — William Miller
(74) *Attorney, Agent, or Firm* — David Noskowicz; Philip H. Burrus, IV

(57) ABSTRACT

A body bag (900) can be assembled by a stitching process while providing increased fluid retention capabilities. An upper outer layer (101) and a lower outer layer (102), each of which can be non-woven materials, form the outer surfaces of the body bag (900). An absorbent layer (103) is disposed between the upper outer layer (101) and the lower outer layer (102). One or more edges (303,403,503,603) can be folded into a periphery (332) of the body bag (900). Stitching (802) can then be applied along the periphery (332) such that the stitching (802) passes through the upper outer layer (101), the lower outer layer (102), an upper edge (994) of the fold in the absorbent layer (103), and a complementary bottom edge (995) of the fold in the absorbent layer (103). Handles (1001, 1002,1003,1004) can be included as well.

14 Claims, 10 Drawing Sheets

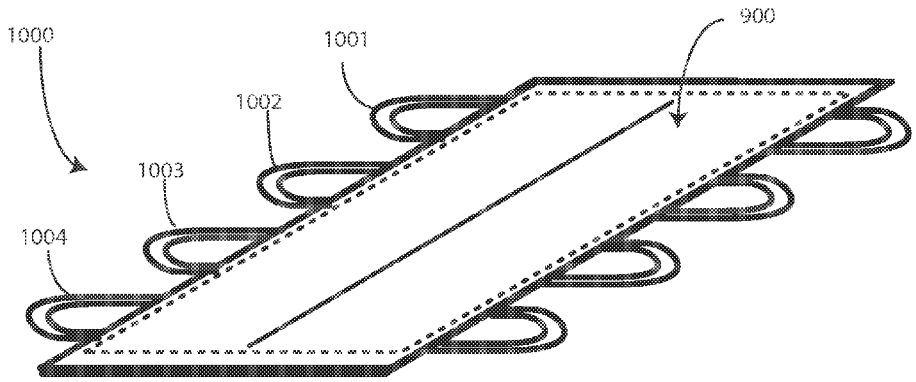
FIG. 10
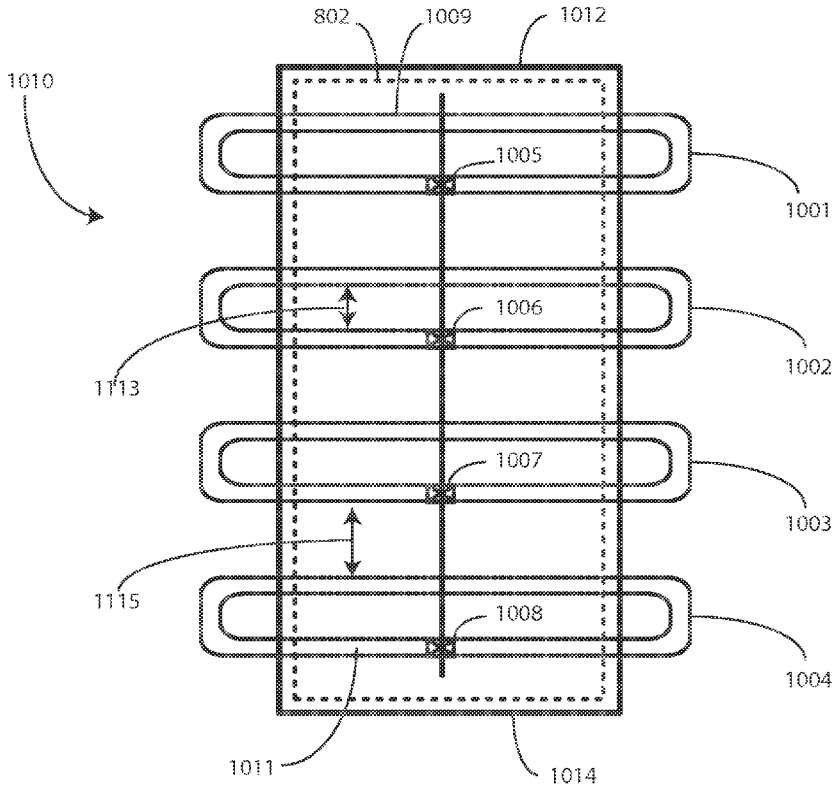

BODY BAG HAVING ABSORBENT LINING AND IMPROVED PERIPHERAL SEAL

TECHNICAL FIELD

This invention relates generally to body bags or cadaver containment devices, and more particularly to a body bag having an interior lining.

BACKGROUND ART

When a person or animal dies and needs to be transported, the remains are generally placed within a body bag or cadaver pouch. Transporting and securing the remains of deceased persons or animals presents numerous challenges. First, it is often necessary to conceal the remains from view. Second, care must be taken to prevent contact of the remains with the personnel transporting the same. Third, the body bag must be designed such that the remains can be easily inserted therein. Fourth, the body bag must be strong enough to facilitate lifting, moving, and otherwise carrying the remains.

Another complicating factor affecting body bag designs is the nature of deceased remains. Frequently fluids can leak from the remains. If they are allowed to escape the body bag, contamination of the surrounding environment or personnel can result. Further, leakage can weaken the construction of body bags, leading to compromised performance The fact that bacterial decay can be accelerated when remains are sealed within a bag further complicates designs.

Accordingly, it would be advantageous to have a body bag that could be efficiently and cost-effectively manufactured while ensuring that one or more of the above functions are accommodated.

BRIEF DESCRIPTION OF THE DRAWINGS

The accompanying figures, where like reference numerals refer to identical or functionally similar elements throughout the separate views and which together with the detailed description below are incorporated in and form part of the specification, serve to further illustrate various embodiments and to explain various principles and advantages all in accordance with the present invention. Note that while the figures below illustrate apparatus components associated with one or more embodiments of the invention, when viewed sequentially, in various combinations, the figures illustrate the steps of a method for constructing a body bag configured in accordance with one or more embodiments of the invention.

FIG. 10 illustrates optional features suitable for use with one or more embodiments of the invention.

Figure 1:
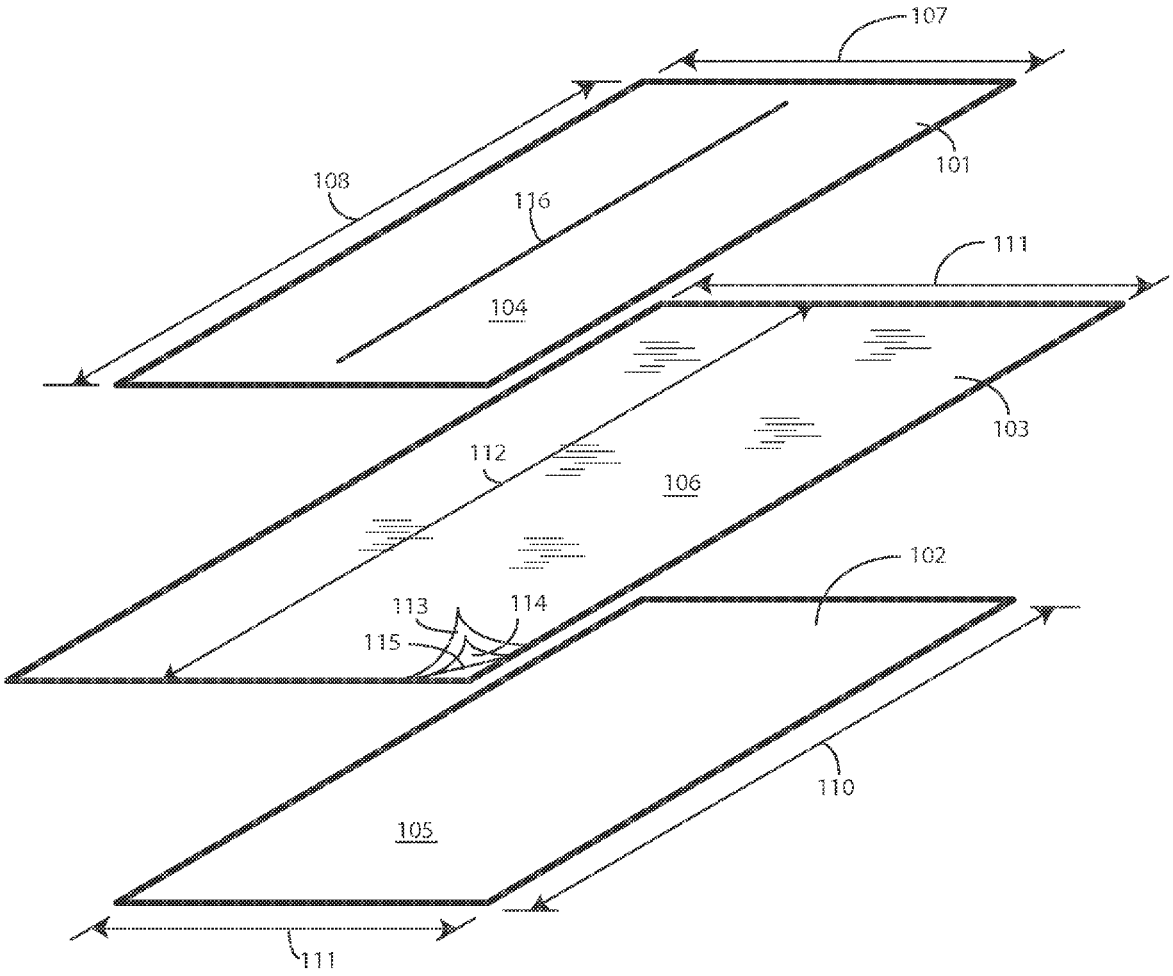
FIG. 1 illustrates an exploded view of layers of a body bag configured in accordance with one or more embodiments of the invention.

Skilled artisans will appreciate that elements in the figures are illustrated for simplicity and clarity and have not necessarily been drawn to scale. For example, the dimensions of some of the elements in the figures may be exaggerated relative to other elements to help to improve understanding of embodiments of the present invention.

DETAILED DESCRIPTION OF EMBODIMENTS OF THE INVENTION

Before describing in detail embodiments that are in accordance with the present invention, it should be observed that the embodiments shown in the figures depict combinations of method steps and apparatus components related to a body bag and its corresponding construction. Any process descriptions should be understood as representing steps tied to a machine or apparatus, in that an automated assembly, sewing, or construction machine can be configured to execute the process descriptions or method steps. Alternate implementations are included, and it will be clear that functions may be executed out of order from that shown or discussed, including substantially concurrently or in reverse order, depending on the functionality involved. Accordingly, the apparatus components and method steps have been represented where appropriate by conventional symbols in the drawings, showing only those specific details that are pertinent to understanding the embodiments of the present invention so as not to obscure the disclosure with details that will be readily apparent to those of ordinary skill in the art having the benefit of the description herein.

Embodiments of the invention are now described in detail. Referring to the drawings, like numbers indicate like parts throughout the views. As used in the description herein and throughout the claims, the following terms take the meanings explicitly associated herein, unless the context clearly dictates otherwise: the meaning of "a," "an," and "the" includes plural reference, the meaning of "in" includes "in" and "on." Relational terms such as first and second, top and bottom, and the like may be used solely to distinguish one entity or action from another entity or action without necessarily requiring or implying any actual such relationship or order between such entities or actions.

Embodiments of the present invention provide a body bag having outer layers and a folded, absorbent layer. The outer layers can be made from traditional materials, such as vinyl or PVC. However, in one embodiment, a non-woven body bag uses non-woven outer layers instead of more traditional materials, such as vinyl or PVC. The use of a non-woven material offers several advantages over prior art designs. As will be shown below, a unique folded peripheral design allows layers of embodiments of the present invention to be sewn together. The use of a non-woven material helps to prevent tearing that can be prevalent when layers of vinyl are sewn together. Further, the use of non-woven material as the outer layers can help to slow the bacterial decay that is frequently accelerated when remains are sealed in materials such as vinyl.

Embodiments of the invention also incorporate a non-woven absorbent polymer layer disposed between outer layers. The absorbent polymer layer serves as a liner disposed along an interior of the body bag and works to absorb any lost fluids emanating from the cadaver or remains disposed within the body bag. In one embodiment, the absorbent polymer layer is constructed from a superabsorbent polymer. Superabsorbent polymers are sometimes referred to as slush powders. Such materials absorb liquids through a hydrogen bonding process that occurs with water molecules of a fluid to be collected.

The absorbent polymer layer functions as a fluid collection apparatus during the collection and transportation of the cadaver or remains. The absorbent polymer layer solves issues of fluid leakage occurring in prior art body bags, especially along seams or component junction points. In one or more embodiments, the absorbent polymer layer has a folded configuration along a periphery of the body bag. Accordingly, two non-woven layers can be sewn together through a folded component of the absorbent polymer layer to ensure fluids are retains, even at the stitch boundaries. The folded periphery configuration provides advantages over prior art bags where absorbent layers do not extend to the seams, in that the folded, absorbent polymer layer can fill holes in the seams to prevent fluid from passing through the same.

In one or more embodiment, handles or straps can be attached to the body bag to make the transportation process simpler and more efficient. Handles or straps, which may be sewn or otherwise attached to an underside of the body bag, make lifting and carrying the body bag easier.

Turning now to FIG. 1, illustrated therein is an exploded view of three layers of one explanatory body bag configured in accordance with one or more embodiments of the invention. The three layers include an upper outer layer 101, a lower outer layer 102, and an absorbent layer 103. While the upper outer layer 101 and lower outer layer 102 can be made from liquid impervious materials, such as vinyl, polyvinyl, PVC, or other materials, in one embodiment the upper outer layer 101 and lower outer layer 102 are manufactured from a non-woven material. The construction of embodiments of the absorbent layer 103, which is described in more detail below, can include superabsorbent polymers.

Each layer has a major face associated therewith. The upper outer layer 101 has an upper outer layer major face 104, while the lower outer layer 102 has a lower outer layer major face 105. Similarly, the absorbent layer 103 has an absorbent layer major face 106. In one embodiment, the area of the absorbent layer major face 106 is greater than one of the upper outer layer major face 104 or the lower outer layer major face 105. In another embodiment, the absorbent layer major face 106 is greater than both the upper outer layer major face 104 and the lower outer layer major face 105.

Illustrating by example, in one embodiment the width 107 of the upper outer layer 101 is about thirty-six inches. The terms "about" and "substantially" are used herein to refer to dimensions or specifications that are inclusive of manufacturing and material tolerances. For example where the width 107 of the upper outer layer 101 is about thirty-six inches, this may include 35.423 inches or 36.789 inches where the manufacturing tolerances are plus or minus one inch. With this in mind, in one embodiment the upper outer layer 101 has a length 108 of about ninety inches.

The lower outer layer 102 can have dimensions that are the same or different form the upper outer layer 101. For instance, in one embodiment the lower outer layer 102 has a width 109 of about thirty-six inches. However, this width 109 can also be greater than, or less than, about thirty-six inches. Similarly, the lower outer layer 102 has a length 110 that is about ninety inches in one embodiment. However, the length 110 can also be greater than, or less than, about ninety inches as well.

In one embodiment, to provide an absorbent layer major face 106 that is greater than one or more of the upper outer layer major face 104 or the lower outer layer major face 105, the width 111 of the absorbent layer 103 is about thirty-eight inches. In one embodiment the length 112 of the absorbent layer 103 is about ninety-two inches. In an embodiment where these dimensions are used, and the other layers measure about thirty-six inches by ninety inches, the absorbent layer major face 106 can be configured to be about eight percent larger than one or more of the upper outer layer major face 104 or the lower outer layer major face 105. As will be described below, when the absorbent layer major face 106 is greater than one or more of the upper outer layer major face 104 or the lower outer layer major face 105, this enables a folded construction which facilitates improved fluid retention, especially at the seams.

In one embodiment, the absorbent layer 103 is constructed from multiple layers of material. For example, in one explanatory embodiment, a first layer 113 comprises a non-woven sheet layer having a weight per area of between 10 grams/square meter and 40 grams/square meter, one example of which is a 20 gram/square meter non-woven material. The first layer 113 can be manufactured from a 20-gram spunbond-meltblown-spunbond (SMS) material. Other materials can be used for the first layer 113 as well, including, for example, cotton or synthetic fiber textiles. Additionally, various woven, non-woven, hydro entangled materials, and/or combinations thereof, absorbent air laid, spun lace, blends of polyester, polypropylene, polyethylene, urethane, and/or combinations thereof, using various methods, including the SMS method, a spunbond-metblown-metblown-spundbond method (SMMS), and a spunbond-metblown-metblown-spundbond method (SMMMS). Examples of suppliers of such materials include Cardinal Health in Dublin, Ohio, Kimberly Clark in Neena, Wis., Molnycke Health Care in Newtown, Pa., and Precept Medical Products, Inc., in Arden, N.C. These materials and methods are explanatory only, as others will be readily apparent to those of ordinary skill in the art having the benefit of this disclosure. For example, one or more antimicrobial layers, treatments, or additives can be added to enhance antimicrobial protection. Further, charcoal or other odor absorbing materials can be integrated into the materials above to absorb odors.

In one embodiment, the second layer 114 comprises an 80 gram/square meter absorbent layer. In one embodiment, the second layer 114 comprises superabsorbent polymers that can absorb and retain large amounts of liquid relative to their own initial mass. The total absorbing capacity of such materials is determined by the type and degree of cross-linking elements used to make the material. Some superabsorbent polymers can absorb 500 times their weight. Others may only absorb 50 times their weight. The absorbing capacity is also affected by the ionic concentration of cross-linked hydrogels used in their construction. When used in the absorbent layer, such a material can yield an absorbent layer capable of absorbing between 1000 cubic centimeters and 5000 cubic centimeters of liquid. It will be clear to those of ordinary skill in the art having the benefit of this disclosure that this range is explanatory only, and that others can be used without departing from the spirit and scope of the invention.

The third layer 115 comprises a thin film sheet in one embodiment. One example of such a sheet is a clear polyethylene film sheet having a weight of 20 grams/square meter.

For example, in one embodiment the third layer 115 can be manufactured from clear 0.05 mm polyethylene sheeting. It should be noted that other clear, flexible materials may be used in place of polyethylene.

When combined the first layer 113, second layer 114, and third layer 115 form one embodiment of an absorbent layer 103. While the construction described above is one form of absorbent layer, it will be obvious to those of ordinary skill in the art having the benefit of this disclosure that other absorbent or superabsorbent layer constructs can be used without departing from the spirit and scope of the invention.

In one embodiment, one of the upper outer layer 101 or the lower outer layer 102 defines an aperture 116 through which a cadaver or other remains may be placed within the body bag. While the illustrative aperture 116 shown in FIG. 1 is straight and runs lengthwise, it will be obvious to those of ordinary skill in the art having the benefit of this disclosure that the aperture 116 could equally run width-wise. Additionally, the aperture 116 could be curved, piecewise linear, or combinations thereof instead of straight. In the illustrative embodiment of FIG. 1, the upper outer layer 101 defines an aperture 116 that serves as an insertion point for the body bag once fully constructed.

The aperture 116 can be selectively closable and sealable in one or more embodiments. A sealing device can be included to allow personnel to selectively open and close the aperture 116. For example, in one embodiment the sealing device can be a zipper disposed along a length of the aperture. In another embodiment, the sealing device comprises a plurality of ties. A first set of ties can be placed on one side of the aperture 116, while complementary ties are disposed along the other side of the aperture at periodic intervals. In yet another embodiment, the sealing device can be a hook and loop fastener, with hooks disposed on one side of the aperture 116, while loops are disposed on the other side of the aperture 116. In yet another embodiment, the sealing device comprises a plurality of snap fasteners. A first snap feature is placed on one side of the aperture 116, while remaining snap features are disposed along the other side. Other sealing devices will be readily apparent to those of ordinary skill in the art having the benefit of this disclosure.

Figure 2:
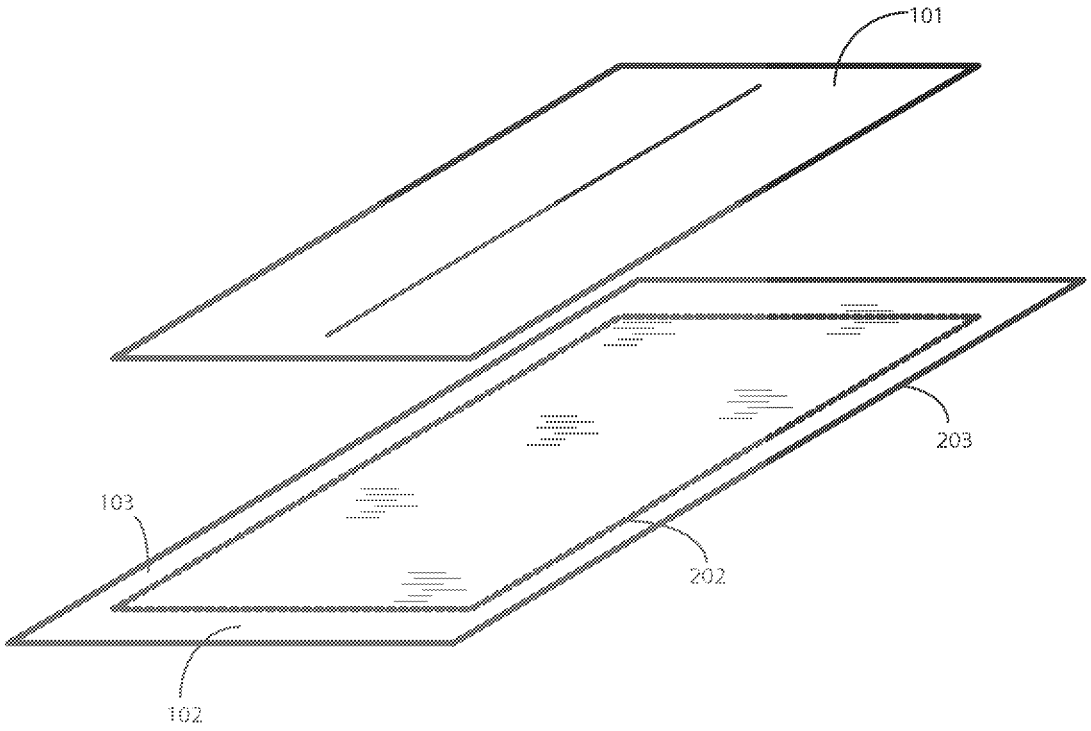
FIG. 2 illustrates an exploded view of layers of a body bag after a construction step has been completed in accordance with one or more embodiments of the invention.

Turning to FIG. 2, illustrated therein are the upper outer layer 101, the absorbent layer 103, and the lower outer layer 102. In FIG. 2, the absorbent layer 103 lays flush on the lower outer layer 102 in the first step of a body bag manufacturing or construction process. The illustrative absorbent layer 103 of FIG. 2 has an area that is greater than that of the lower outer layer 102. This can be seen by the absorbent layer perimeter 203 extending beyond the lower outer layer perimeter 202.

Figure 3:
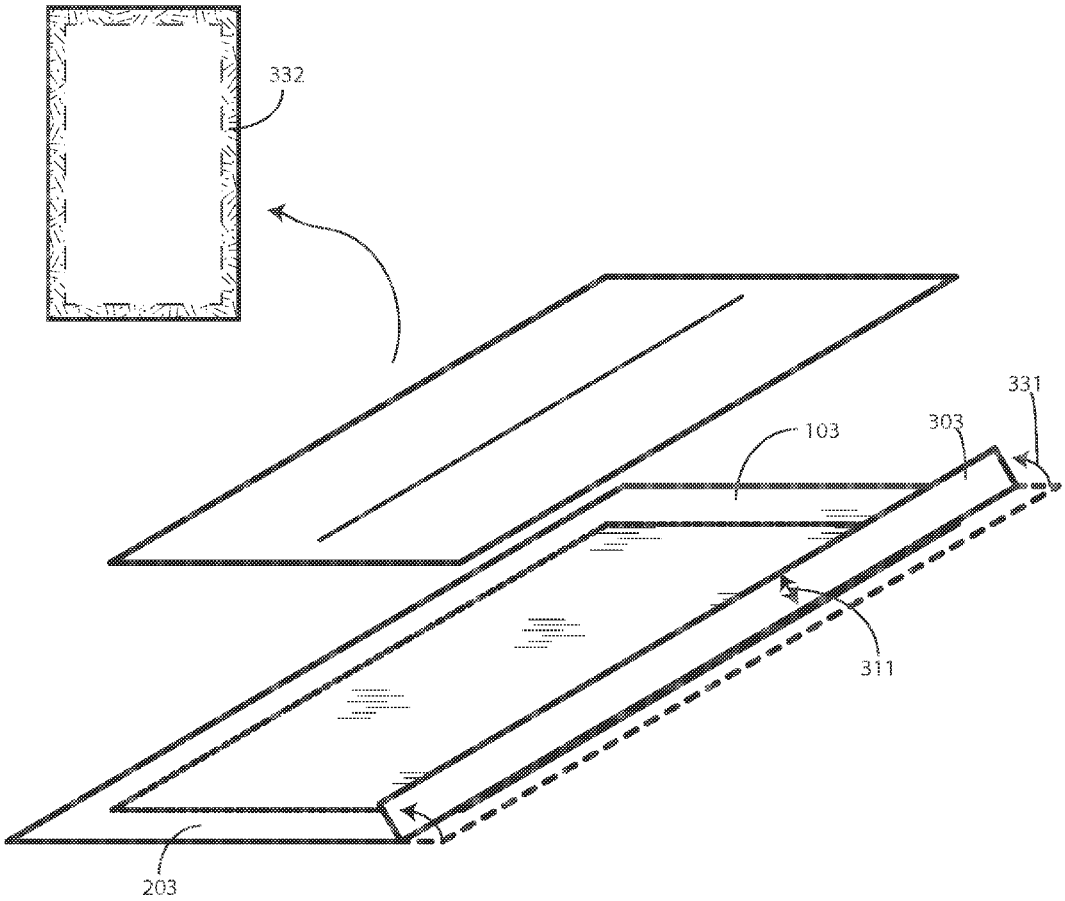
FIG. 3 illustrates an exploded view of layers of a body bag after another construction step has been completed in accordance with one or more embodiments of the invention.

Turning to FIG. 3, illustrated therein is another step of one manufacturing or construction process for the body bag. As mentioned above, in one or more embodiments, the body bag is manufactured with the absorbent layer 103 having a folded construction along the periphery 332. In one embodiment, the term "periphery" is used to refer to an area of between one half inch and four inches from the absorbent layer perimeter 203. For example, in one embodiment the periphery 332 is used to refer to an area between the absorbent layer perimeter 203 and two inches into the absorbent layer 103 from the absorbent layer perimeter. Such an embodiment is shown in FIG. 3.

As shown in FIG. 3, a first edge 303 of the absorbent layer 103 having a width 311 of about one inch, is folded 331 toward an interior of the absorbent layer 103. Accordingly, the half of the periphery 332 of two inches is folded over another half of the periphery 332.

Figure 4:
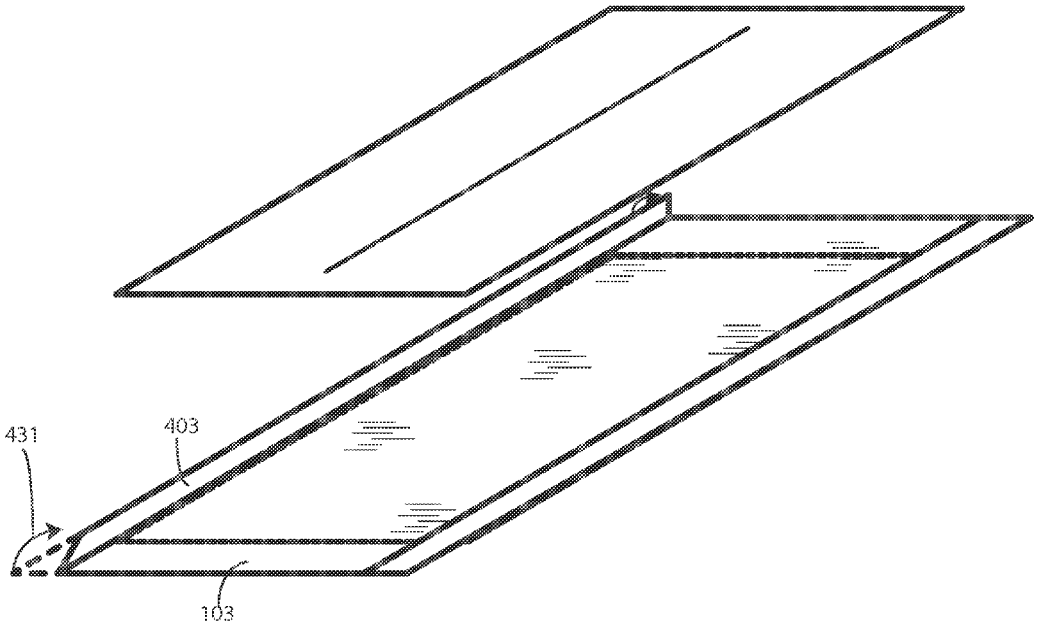
FIG. 4 illustrates an exploded view of layers of a body bag after another construction step has been completed in accordance with one or more embodiments of the invention.

A similar step occurs in FIG. 4. Specifically, a second edge 403 of the absorbent layer 103 is folded 431 toward an interior of the absorbent layer 103. In FIG. 4, as with FIG. 3, the explanatory dimension of the second edge 403 is about one inch. Accordingly, since the explanatory periphery (332) is two inches, half of the periphery 332 is folded over another half of the periphery 332.

Figure 5:
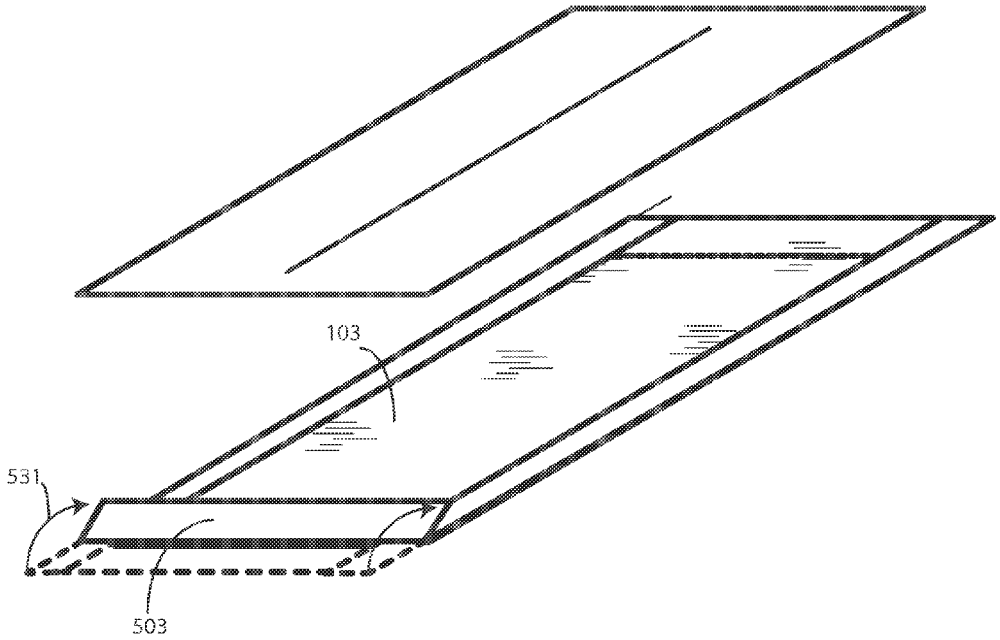
FIG. 5 illustrates an exploded view of layers of a body bag after another construction step has been completed in accordance with one or more embodiments of the invention.
Figure 6:
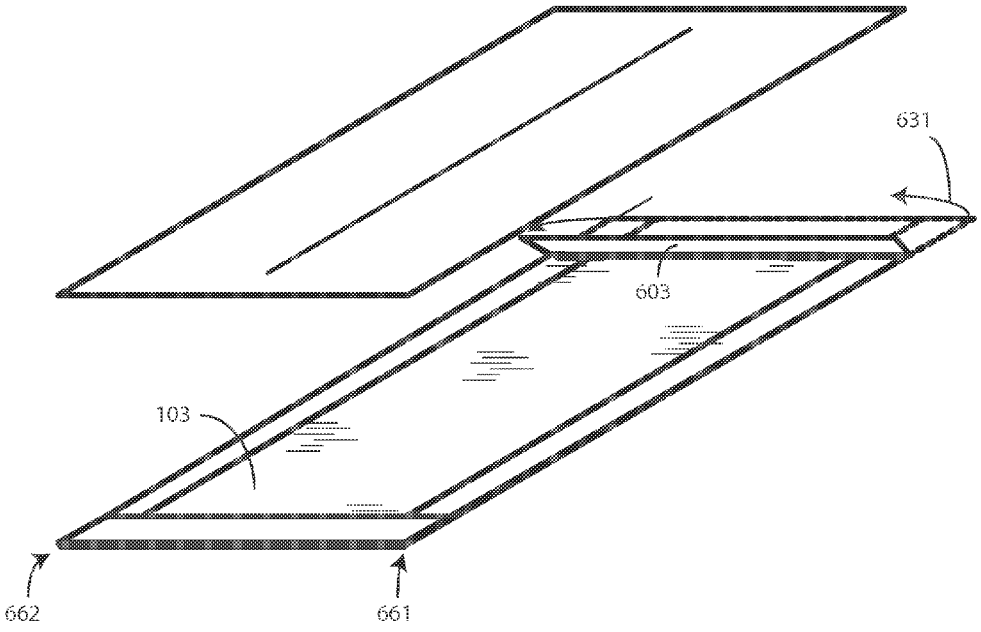
FIG. 6 illustrates an exploded view of layers of a body bag after another construction step has been completed in accordance with one or more embodiments of the invention, with an absorbent layer being folded with an overlapping fold.

The ends are then folded in FIGS. 5 and 6. Beginning with FIG. 5, a third edge 503 of the absorbent layer 103 is folded 531 toward an interior of the absorbent layer 103. In FIG. 6, a fourth edge 603 is folded 631 toward an interior of the absorbent layer 103. It should be noted that the folding processes occurring in FIGS. 3-6 can occur in any order. It should also be noted that while a single fold occurring along the periphery 332 is shown in FIGS. 3-6, embodiments of the invention are not so limited. Multiple folds can be used as well. Where multiple folds are used, the multiple folds can be formed by rolling the edges of the absorbent layer, forming accordion folds, or other types of folds.

Figure 7:
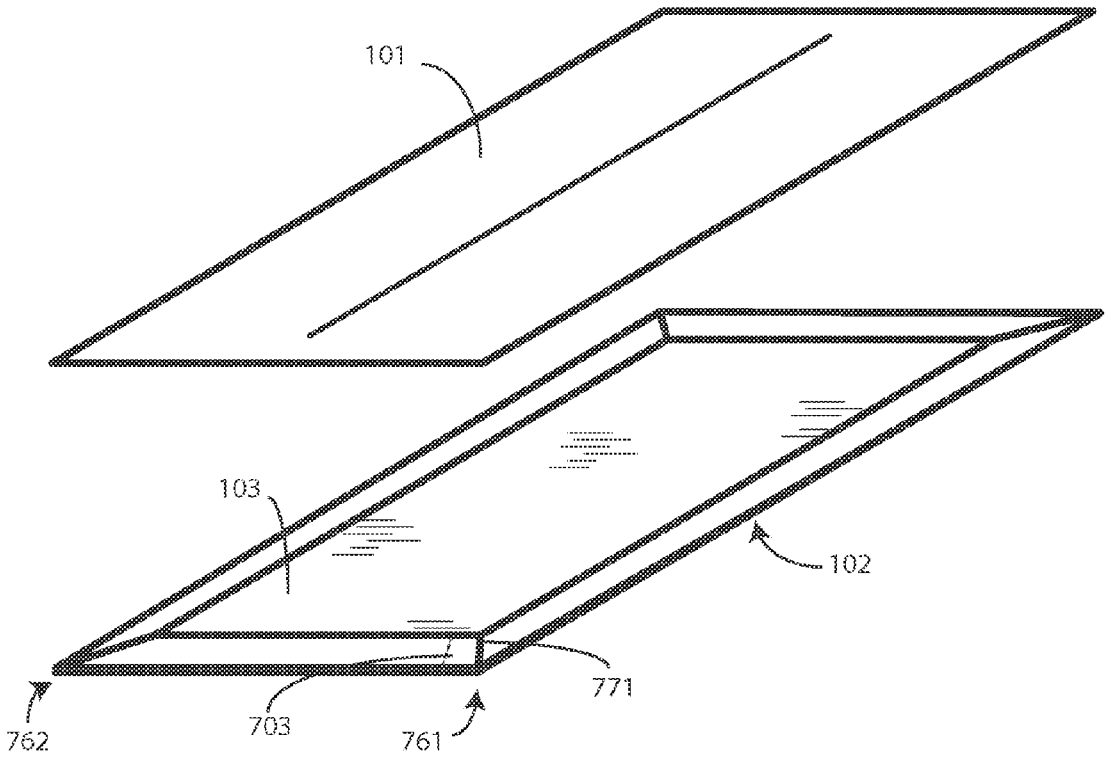
FIG. 7 illustrates an exploded view of layers of a body bag having corner folds in an absorbent layer in accordance with one or more embodiments of the invention.

The folds disposed at corners 661,662 of the absorbent layer 103 can be configured in various ways. As shown in FIG. 6, the corners have an overlapping fold where each edge is simply folded atop a previously folded edge. By contrast, as shown in FIG. 7, each corner 761,762 is configured as a corner fold, with a corner portion, e.g., corner portion 703, tucked beneath a corresponding edge so as to form a diagonal parting line 771 at each corner 761,762. Other folds can be used as well.

Once the absorbent layer 103 has been folded along each of its edges, regardless of whether a single or multiple folds are used, the upper outer layer 101 is placed atop the absorbent layer 103. Accordingly, the absorbent layer 103, with its edges folded, is disposed between the upper outer layer 101 and the lower outer layer 102.

Figure 8:
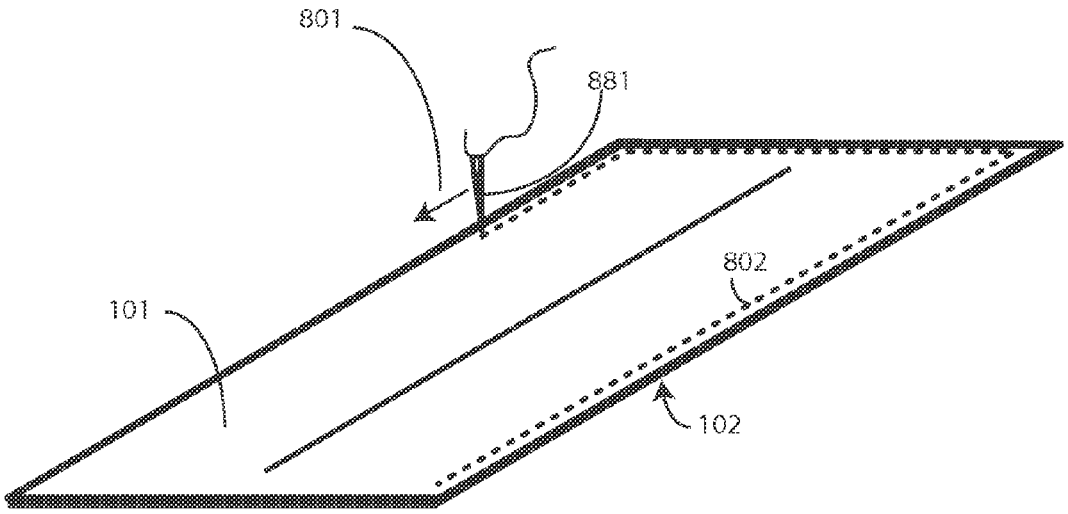
FIG. 8 illustrates a body bag during another construction step, the construction step suitable for use with an absorbent layer having an overlapping fold, corner fold, or other type of fold, configured in accordance with one or more embodiments of the invention.

Turning to FIG. 8, the layers may then be stitched 801 together. In one embodiment, the stitching 802 is disposed within the periphery (332) of the absorbent layer (103) such that each stitch passes through the upper outer layer 101, the folded edge of the absorbent layer (103), which in one embodiment comprises half the periphery (332), the remainder of the periphery (332) of the absorbent layer (103), and the lower outer layer 102. Thus, while three layers are used, folding along the periphery results in each stitch passing through four effective layers, two of which are absorbent due to the folding of the absorbent layer (103). In one embodiment, the stitching 802 comprises a double-stitching process.

Placing the stitching 802 in the periphery atop the folded portion of the absorbent layer (103) provides numerous advantages over prior art body bag designs. Stitching cannot be used with prior art designs because each stitch creates a hole in the outer layer. As these outer layers are traditionally vinyl, these holes lead to fluid leakages. For this reason, heat sealing is generally used in the body bag manufacturing process. Heat sealing is costly, inefficient, and cumbersome. Applicant's construction allows the use of stitching 802, which is less costly and simpler to manufacture. By folding the absorbent layer (103) beneath the stitching 803, two layers of absorbent material are able to swell and expand about the thread, thereby sealing each and every hole made by the needle 881 during the stitching process. Applicant's folded deign solves the problems associated with leakage and fluid retention present in prior art designs.

A second advantage is increased fluid collection capability along each edge of the body bag due to the folded construction at the periphery. When a cadaver or remains are placed inside a body bag, fluid released tends to pool at one end of the bag. This creates an increased fluid leakage risk. The additional absorbency of the folded periphery occurring in embodiments of the present invention is configured in exactly the locations fluid is likely to pool, thereby mitigating the problem.

A third advantage results when non-woven materials are used for the upper outer layer 101 and the lower outer layer 102. It is well known that when a vinyl or polyvinyl, which is frequently used in prior art designs, has a tendency to tear when punctured. The sewing process shown in FIG. 8 makes a series of punctures through both the upper outer layer 101 and the lower outer layer 102. When a non-woven material is used for the upper outer layer 101 and the lower outer layer 102, such a material provides a stronger option that resists tearing.

Figure 9:
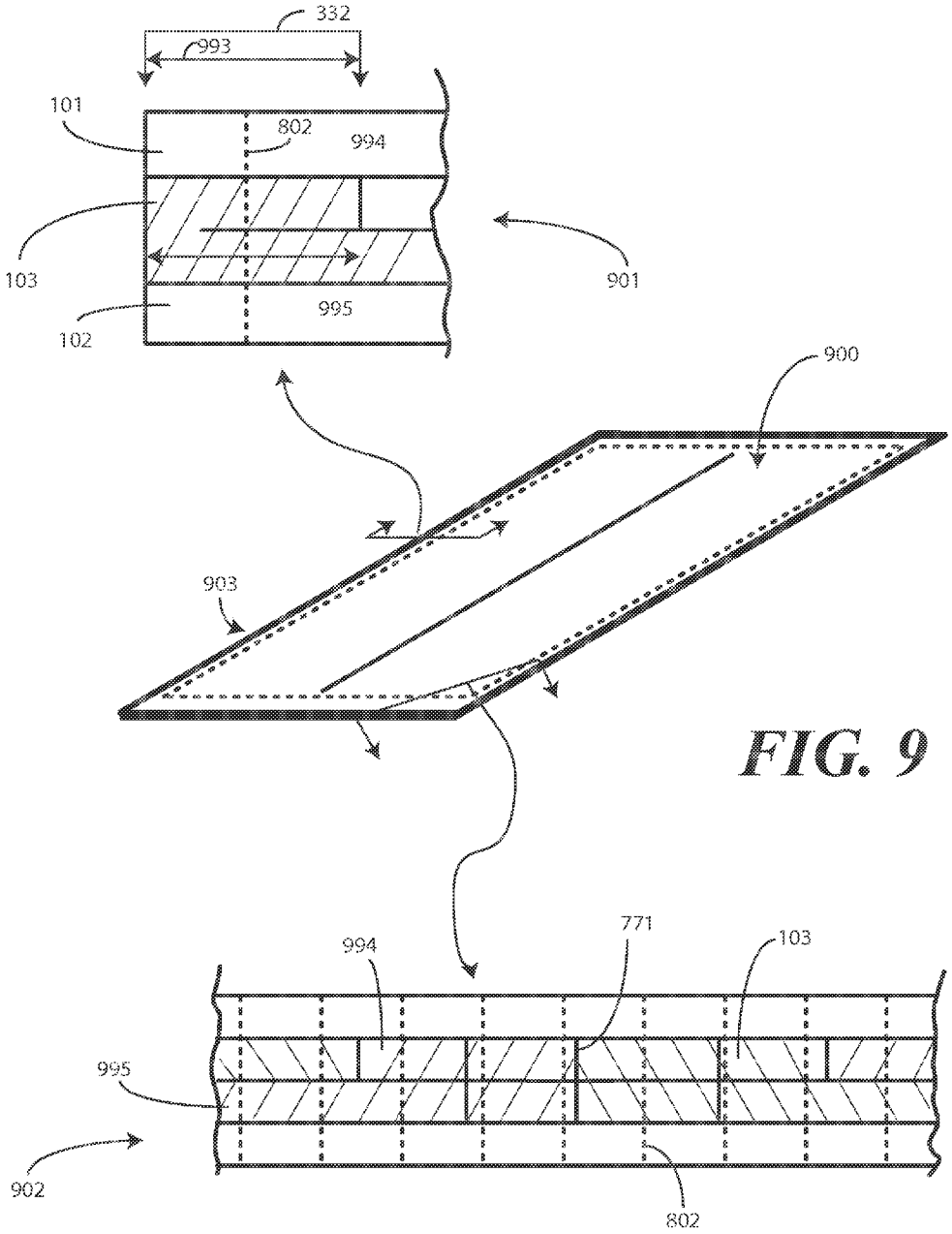
FIG. 9 illustrates a cut-away view showing one embodiment of absorbent layer configuration in accordance with one or more embodiments of the invention.

Turning to FIG. 9, cross sections are shown that illustrate the stitching process occurring along the periphery of one explanatory body bag 900 configured in accordance with one or more embodiments of the invention. Cross section 901 is taken along an edge 903 of the body bag 900, while cross section 902 is taken at a corner 961 of the body bag 900.

Beginning with cross section 901, sectional view of the periphery 332 has a width 993 of about one inch. Within the periphery, the absorbent layer 103 is folded over, with an upper edge 994 of the fold disposed over a complementary bottom edge 995. Accordingly, the absorbent layer 103 forms a "two layer structure" in the periphery 332, with the upper edge 994 forming a first layer and the complementary bottom edge 995 forming a second layer. This two layer structure is disposed between the upper outer layer 101 and the lower outer layer 102. Stitching 802 then passes through the equivalent of four layers as shown. In section 902, which occurs at the corner 961, an edge fold is formed. The upper edge 994 and complementary bottom edge 995 are shown, with stitching passing therethrough.

Turning now to FIG. 10, in one or more embodiments a plurality of handles 1001,1002,1003,1004 can be incorporated with the body bag 900 to make the handling and transport easier. The handles 1001,1002,1003,1004 are shown both in the perspective view 1000 and plan view 1010 of FIG. 10.

In one embodiment, each handle 1001,1002,1003,1004 is formed from a loop of woven material. Other materials, including rope, leather, or synthetic materials can also be used for the handles 1001,1002,1003,1004. In the illustrative embodiment of FIG. 10, each handle 1001,1002,1003,1004 is sewn at a connection point 1005,1006,1007,1008 to form a closed loop.

The handles 1001,1002,1003,1004 can be attached to the body bag 900 in a variety of ways. In the illustrative embodiment of FIG. 10, handles 1001,1002,1003,1004 are attached to the body bag 900 when the stitching 802 is applied to the periphery (332). In such an embodiment, the stitching 802 passes not only through the four layers described above with reference to FIG. 9, but also through the woven material of the handles 1001,1002,1003,1004. In an alternate embodiment, the handles 1001,1002,1003,1004 are attached to the lower outer layer (102) at the connection points 1005,1006,1007, 1008.

The number of handles 1001,1002,1003,1004 can vary. In one embodiment, only two handles are used. In another embodiment, three handles are used. In the illustrative embodiment of FIG. 4, four handles 1001,1002,1003,1004 are used, with each being equally spaced apart from the next.

In one embodiment, the material used to make each handle 1001,1002,1003,1004 comprises a woven strap material having a width of about one inch. In the illustrative embodiment of FIG. 10, handle 1001 and handle 1004 are disposed such that the outer loop portion 1009,1111 is about 12.25 inches from the ends 1012,1014 of the body bag 900. Each loop has an inner spacing 1113 of about five inches. Each loop is separated from the next by a distance 1115 of about 12.5 inches as well. Such spacing provides an even, periodic separation for the handles 1001,1002,1003,1004 when the overall length of the body bag 900 is about ninety inches.

In the foregoing specification, specific embodiments of the present invention have been described. However, one of ordinary skill in the art appreciates that various modifications and changes can be made without departing from the scope of the present invention as set forth in the claims below. Thus, while preferred embodiments of the invention have been illustrated and described, it is clear that the invention is not so limited. Numerous modifications, changes, variations, substitutions, and equivalents will occur to those skilled in the art without departing from the spirit and scope of the present invention as defined by the following claims. Accordingly, the specification and figures are to be regarded in an illustrative rather than a restrictive sense, and all such modifications are intended to be included within the scope of present invention. The benefits, advantages, solutions to problems, and any element(s) that may cause any benefit, advantage, or solution to occur or become more pronounced are not to be construed as a critical, required, or essential features or elements of any or all the claims.

What is claimed is:

1. A body bag for storing remains of a deceased, the body bag comprising:

an upper outer layer defining an upper outer layer major face;

a lower outer layer defining a lower outer layer major face; and an absorbent layer for retaining liquid, the absorbent layer defining an absorbent layer major face, the absorbent layer positioned between the upper outer layer and the lower outer layer;

the absorbent layer including a fold along a periphery of the body bag to define a folded construction, further comprising stitching along the periphery of the body bag, the stitching passing through two edges of the fold, the upper outer layer, and the lower outer layer; and the absorbent layer major face having an area greater than one or more of the upper outer layer major face or the lower outer layer major face.

2. The body bag of claim 1, wherein the upper outer layer and the lower outer layer comprise non-woven material.

3. The body bag of claim 1, further comprising one or more handles coupled to the body bag.

4. The body bag of claim 3, wherein the one or more handles are coupled to the lower outer layer by the stitching along the periphery of the body bag.

5. The body bag of claim 3, wherein each handle comprises a loop coupled at a connection point.

6. The body bag of claim 1, wherein the upper outer layer has an upper layer width and a lower layer width of about thirty six inches and an upper layer length and a lower layer length of about ninety inches.

7. The body bag of claim 1, wherein the absorbent layer comprises:

a non-woven sheet layer;

an absorbent polymer layer; and a thin film sheet layer.

8. A body bag for storing remains of a deceased, the body bag comprising:

an upper outer layer;

a lower outer layer; and an absorbent layer for retaining liquid and being positioned between the upper outer layer and the lower outer layer;

the absorbent layer including at least one fold disposed about a periphery of the body bag;

the upper outer layer, the lower outer layer, and the absorbent layer coupled together by a stitch disposed within the periphery that passes through the upper outer layer, an upper edge of the at least one fold of the absorbent layer, a complementary bottom edge of the at least one fold of the absorbent layer, and the lower outer layer.

9. The body bag of claim 8, wherein the at least one fold comprises an overlapping fold at corners of the body bag.

10. The body bag of claim 8, wherein the at least one fold comprises corner folds at corners of the body bag.

11. The body bag of claim 8, wherein the periphery comprises an area extending from an edge of the absorbent layer into the absorbent layer a distance of about two inches.

12. The body bag of claim 11, wherein the upper edge of the at least one fold of the absorbent layer has a width of about one inch.

13. The body bag of claim 12, wherein the stitch comprises a double stitch.

14. The body bag of claim 8, wherein the at least one fold comprises:

a first edge of the absorbent layer folded into the periphery;

a second edge of the absorbent layer folded into the periphery;

a third edge of the absorbent layer folded into the periphery; and a fourth edge of the absorbent layer folded into the periphery.

* * * * *